United States Patent [19]

Baron

[11] 4,103,453

[45] Aug. 1, 1978

[54] ADJUSTABLE U-CONTROL HANDLE

[76] Inventor: Robert Michael Baron, 834-4th St., Santa Monica, Calif. 90403

[21] Appl. No.: 764,584

[22] Filed: Feb. 1, 1977

[51] Int. Cl.[2] ..... A63H 27/04

[52] U.S. Cl. ..... 46/77; 74/501 R

[58] Field of Search ..... 46/77; 273/95 A, 26 E, 273/58 C; 272/31 A, 31 B; 74/501 R

[56] References Cited

U.S. PATENT DOCUMENTS

| | | | |
|---|---|---|---|
| 2,491,825 | 12/1949 | Meister | 46/77 |
| 2,765,128 | 10/1956 | Barth | 46/77 X |
| 2,808,682 | 10/1957 | Hoyle | 46/77 |
| 3,058,260 | 10/1962 | Sanborn | 46/77 |
| 3,089,278 | 5/1963 | Brinkley, Jr. | 46/77 |
| 3,484,845 | 12/1969 | Warner et al. | 46/77 |

*Primary Examiner*—Samuel Scott
*Assistant Examiner*—Don E. Ferrell

[57] ABSTRACT

This invention relates to an improved handle for attachment of a pair of control cables to a model airplane for control of the latter during flight. The handle consists of a gripping portion which has adjustable parallel bolts extending perpendicularly to the longitudinal axis of the gripping portion. Connected between the parallel bolts is a crossbar to which is attached a pair of slidable nylon guide blocks. Through the adjustment of the guide blocks along the crossbar, the cables to the airplane may be varied in length to properly stablize the plane during flight.

5 Claims, 4 Drawing Figures

FIG. 3
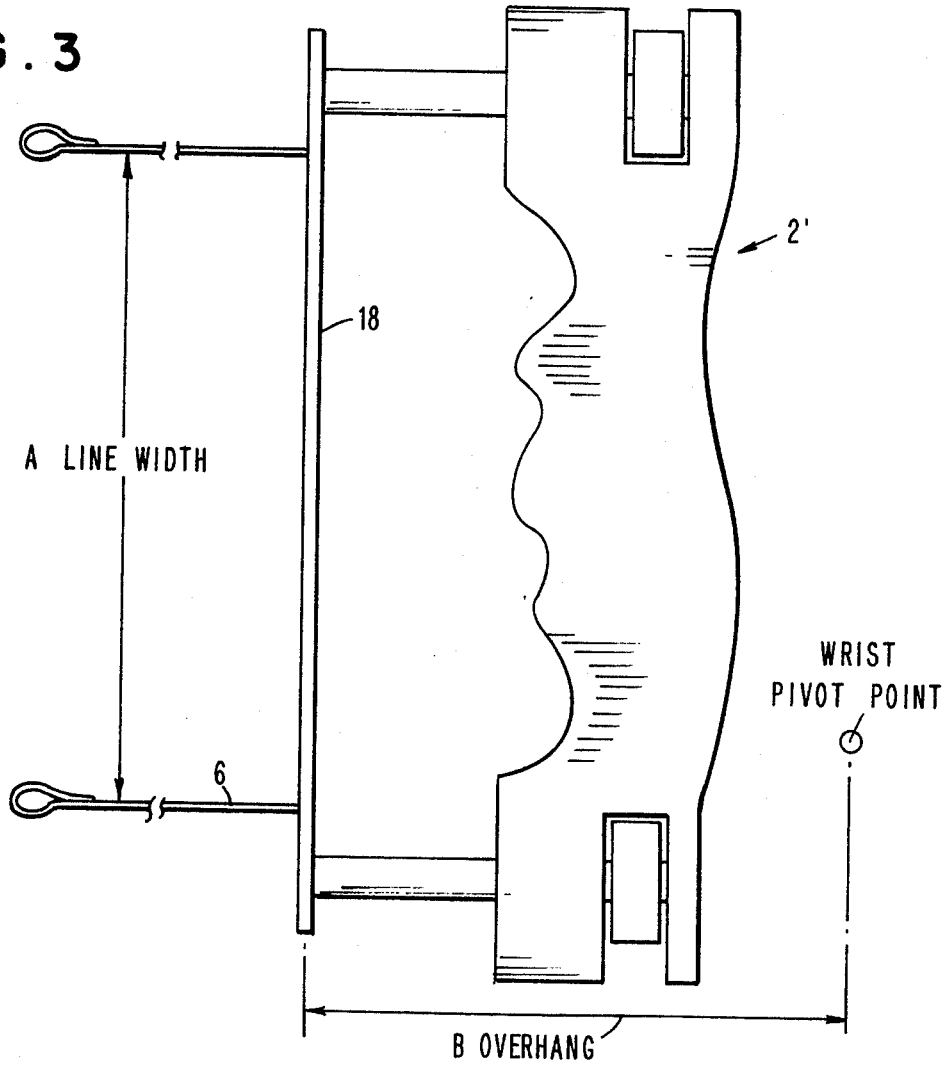
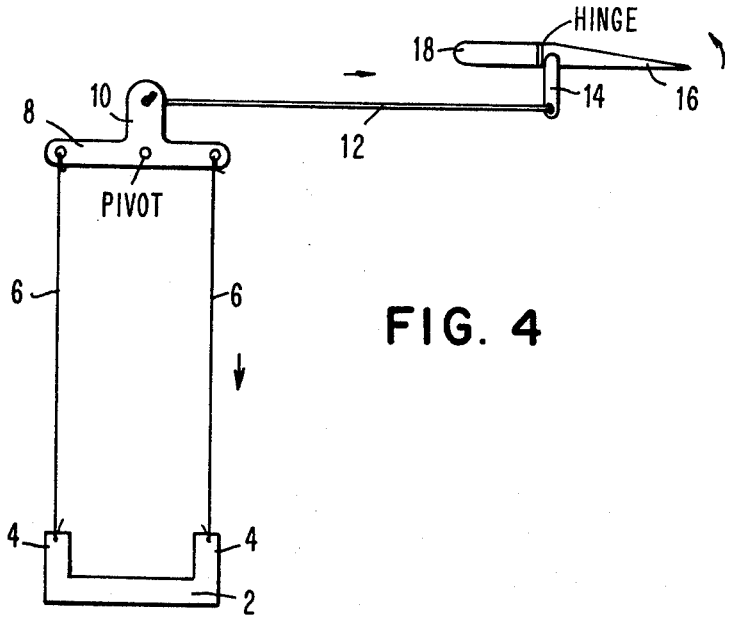
FIG. 4

ADJUSTABLE U-CONTROL HANDLE

BACKGROUND OF THE INVENTION

In the flying of a model airplane powered by an engine, a handle is employed by the operator to control the maneuvers to be performed by the plane. The handle has attached to it a pair of control lines, the latter being connectable to a pivoted bellcrank member so that upward and downward movements of the handle are translated into corresponding upward and downward movements of the plane's hinged elevator so that the plane can be made to climb or dive. When one attaches the control lines of such a commercially available handle to a powered model airplane in order to fly it, repeated flights (wherein the plane is put through certain prescribed maneuvers to test its responsiveness) of the model are made. The plane or airship is then trimmed (adjusted) according to the results of these test flights. If the airship responded too quickly to handle movements, weight was added to the nose region of the ship to slow down its response time. Conversely, if the ship was sluggish (too slow a response time), then weight was added to the ship's tail.

While the above noted procedure for trimming a model plane is simple, it is too unreliable in maximizing the maneuverability capabilities of a well-designed stunt or precision-aerobatic plane. Thus, a plane could be balanced properly aerodynamically, but a too fast or a too responsive control system would make the plane "appear"tail heavy. Adding noseweight to such a plane would be compromising its performance in order to obtain a proper control response or "feel". This illusion is a common occurrence when flying model aerobatic or combat planes that are attached to a U-shaped control line.

If the control system could be slowed down, the plane could be made to "feel" right to the plane's operator without changing the plane's center of gravity, i.e., adding weights either to the nose portion or the tail portion of the plane. The inventive present handle, to be described in detail hereinbelow, provides means for adjusting both the rate of response of the controls of the airplane as well as the force required to operate such control lines so that adjustments can be made on the ground or in the air, during flight, to achieve the maximum maneuverability capabilities of that model plane.

DESCRIPTION OF THE DRAWINGS

FIG. 3 is a schematic showing of the operation of the handle forming this invention to aid in an understanding of the handle's benefit.

FIG. 4 is a generalized showing of a basic conventional U-line handle used in controlling the flight of model airplanes.

As seen in FIG. 4, a U-shaped handle 2 has securely attached to the ends of arms 4 a flexible cable 6. Such cable 6 may be one continuous strand running through the body of handle 2 or it may consist of two separate pieces of cable. The flying wire length from handle to bellcrank 8 varies from 50–70 feet, and the bellcrank 8 is permanently but pivotally affixed to a suitable location within the body of the plane (not shown). The movable arm 10 of bellcrank 8 accommodates one end of a pushrod 12 and the other end of said pushrod 12 is affixed to one end of a control horn 14, whose second end is hinged to the plane's elevator 16 that is located adjacent the plane's stabilizer 18. As can be seen, when the engine-powered U-line controlled plane is flying in a circle at a given height above the ground, the plane's operator is gripping the handle 4 and is rotating in a small radius circle as the plane rotates in its large radius circle. By rotating the handle in an "upward" (clockwise) direction, the combined motions of bellcrank 8, pushrod 12 and control horn 14 cause elevator 16 to move upward from its neutral position, resulting in an upward movement of the plane. If the operator moves the hand 4 in a "downward" (counterclockwise) direction, then the elevator 16 moves below its neutral position, resulting in a downward movement of the plane. Almost all commercially available handles are fixed grip, unadjustable types and thus are very limited in their ability to obtain the maximum flying characteristics of the planes being flown by the users of such handles; and in competitive precision aerobatics wherein only one to five points may separate the first three competitors attaining scores as high as 650, every advantage that can be employed in improving precision stunt flying must be exploited.

Figure 2:
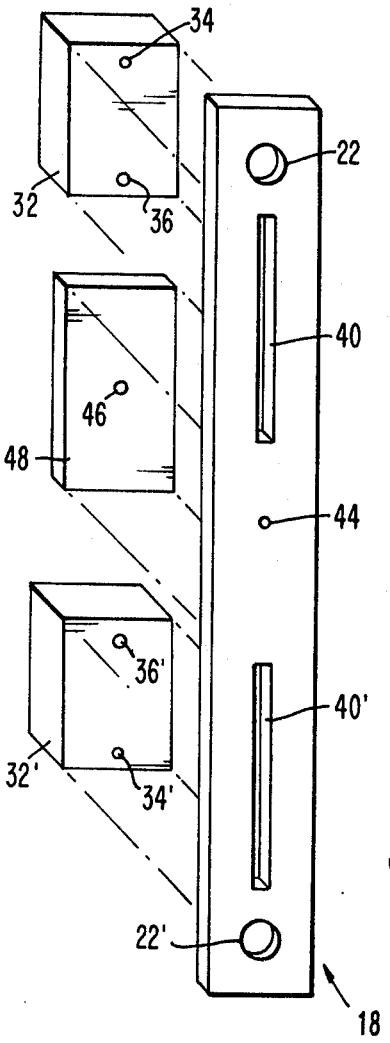
FIG. 2 is a front view in exploded perspective of two nylon blocks and an aluminum cross bar that form important features of the novel handle.
Figure 1:
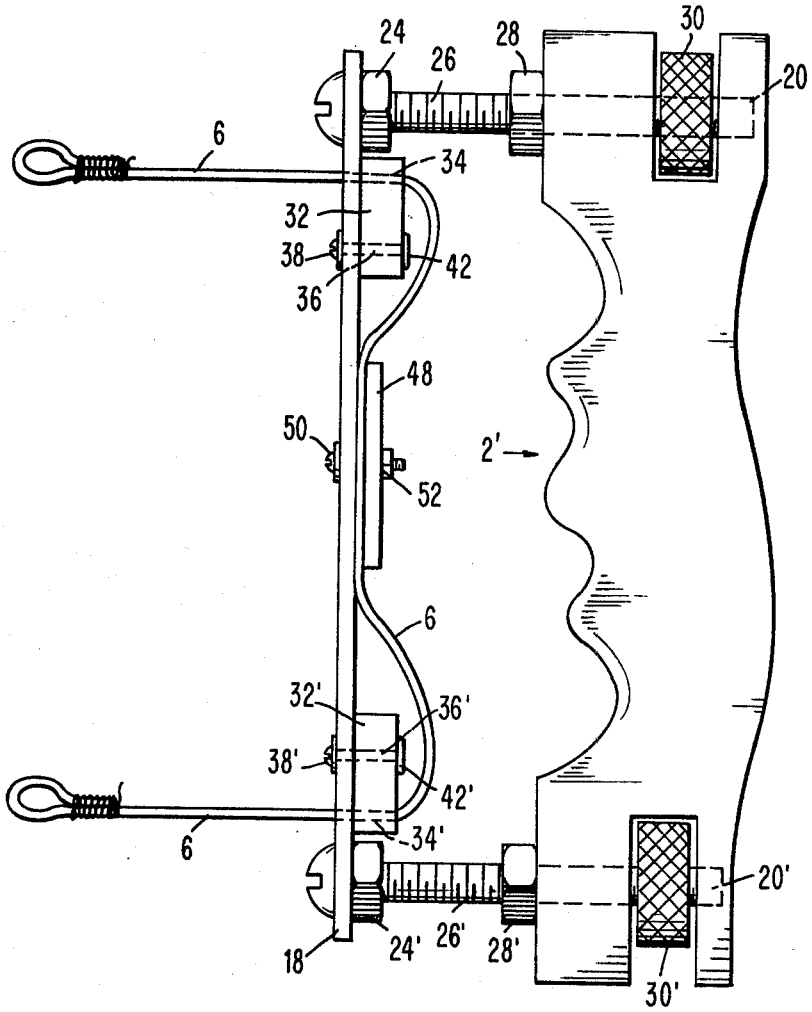
FIG. 1 is a side view of a preferred embodiment of the invention.

Before describing in detail the novel handle shown in FIGS. 1 and 2, FIG. 3 will be relied upon as an aid in understanding the benefits to be derived from the adjustable U-line control handle comprising the present invention. The role of an adjustable control handle is to alter both the rate (response time) and force required to achieve such rate. By changing the distance between parallel cables 6, which distance A is termed "Line Width" in FIG. 3, the rate of response can be changed, namely, greater line widths produce greater rates. By modifying the distance between the flyer's wrist's pivot point and a crossbar 18 of a handle 2 to which the cable 6 is attached, which distance B is termed "Overhang", the force needed to control the model airplane in flight is modified, i.e., longer overhang increases such force required and smaller overhang lowers the force required to control the plane.

DESCRIPTION OF NOVEL U-CONTROL HANDLE

The gripping portion of handle 2′ of FIG. 1 is cut from a core of soft pine wood that is 9/16 inch in thickness and long enough to be gripped comfortably. Holes 20 and 20′, shown in dotted lines in the drawing, are drilled on a drill press to assure parallelism, in that the handle loses a good deal of its accuracy if the holes 20 and 20′ are not parallel to each other. The core is smoothed, sanded and otherwise treated to provide a comfortable fit for the average hand that will use the handle. A relatively quick-hardening paste is formed by mixing suitable resins (my particular paste was formed of micro-balloons and K+B resin). Micro-balloons are tiny grains of phenolic resin, each grain being a hollow sphere. When the latter is mixed with a polyester resin, a relatively low density, high strength mixture, suitable for molding and filling, is produced. Micro-balloons are manufactured by Union Carbide, Old Saw Mill River Rd., Tarrytown, N.Y. 10591. K+B resin is a brand name that is manufactured by the K+B Mfg. Division of Aurora Products Corp., 12152 Woodruff Ave., Downey, Calif. 90241. The paste is spread over the smoothed core and is then grasped with the hand or hand-type that will ultimately be using the handle during flight. The resin, after being fully cured, is sanded to remove all sharp edges and smoothed and lacquered to provide a comfortable seat for the flyer's fingers and palm.

The crossbar 18 that is incorporated into the adjustable U-line control handle is a ⅛ inch thick piece of aluminum 2024. The aluminum crossbar 18 is placed on a drill press prior to cutting holes 22 and 22' therein for passage therethrough of nuts 24 and 24', respectively. Associated with bolt 26 is a locking nut 28 and adjustable nut 30. Likewise, associated with bolt 26' is locking nut 28' and adjustable nut 30'.

The line width adjustment unit is formed of two nylon blocks 32 and 32', respectively, a hole 34 in nylon block 32 serving as a guide for screw 38 that passes not only through hole 36 but also through slotted opening 40 in aluminum plate 18. Blind nut 42 is attached to nylon guide block 32 so that nylon guide block 32 can be adjustably secured along the length of aluminum plate 18. Elements 38', 40' and 42' serve identical roles as their counterparts 38, 40 and 42. A hole 44 is drilled in the center of plate 18 and a similar hole 46 is drilled in a 1/16 inch brass plate 48, so that a screw 50 and nut 52 can adjustably affix cable 6 to aluminum bar 18.

DESCRIPTION OF USE OF HANDLE IN PERFORMING PRECISION-AEROBATICS

In trimming (attaining peak performance from a completed model airplane) a control-line stunt plane, cable 6 must be adjustable and weights must be added to either the front or rear regions of the plane. The handle is first adjusted by loosening nut 52 and sliding cable 6 until an approximate adjustment is made so that neutral control on the elevator 16 corresponds to a comfortable neutral position for the flier. Then nut 52 is tightened so that cable 6 is securely clamped under the clamp 48. The plane is then held during the running of the engine and the plane is alternately held in an inverted position and in an upright position to ascertain if the engine is running at the same speed in both positions. If the speeds differ, then either the engine or the fuel tank is shimmed either up or down until equal speeds are attained in the inverted and upright positions, respectively. A person assisting the flyer should stand outside the flying circle of the stunt plane and observe whether the wings of the plane are level in both the inverted and upright positions. If they are not level in these two positions, then the wings must be steamed to eliminate warps in them.

After these two initial tests have been made, the flyer observes the conditions of the flaps during flight. They must be exactly level. Additionally, if the outboard wing is high during flight both in the upright and inverted positions, more weight is needed in the tip of that outboard wing. Correspondingly, if the outboard wing is low during flight in both such noted positions, then less weight is needed in the tip of the outboard wing. The center of gravity of the plane is determined by flying the plane with various weights temporarily located in the nose or tail and observing the plane in its glide (engine stopped) prior to landing. If the plane assumes a nose-up glide prior to landing, then the plane is tail heavy. If the control line handle must be turned toward its "up" direction to maintain a flat glide approach, then the plane is nose heavy. If the glide is flat without any or negligible "up" control needed, then the plane's center of gravity is proper and the temporarily affixed weights placed in the plane are permanently affixed (using glue or epoxy) to the inner portions of the plane as far forward or aft as practical.

At this point in the final trimming, the value of the adjustable handle becomes evident. The screws 38 and 38' are slightly loosened so that nylon blocks 32 and 32' can be moved up or down crossbar 18, leaving the cable 6 portion within the handle region to move up or down. The guides 32 and 32' should be moved only in increments of an ⅛ foot or less. Prior to flight, screws 38 and 38' must be tightened. If, as a result of these small incremental changes in portion of guide plates 32 and 32', the guides 32 and 32' are placed too close to center hole 44, the plane will be very stable in level flight, but insufficient control travel may be available for all the aerobatic maneuvers. If the guide blocks 32 and 32' are too far from center hole 44, the plane will perform the required maneuvers crisply, but may be too sensitive for precision placement of the aircraft. When the proper locations of the guide blocks are found, the screws are tightened to secure the final location of the cable 6 with respect to the trimmed plane. A second handle adjustment, namely, the force needed to carry out the maneuvers, is accomplished by rotating the adjusting nuts 30 or 30' prior to flight and while locking nuts 28 and 28' are loose. When the proper force, comfortable to the flyer, is achieved, locking nuts 28 and 28' are closed. Nuts 30 and 30' may be turned individually while the plane is flying to obtain a very precise neutral hand position that corresponds to level flight. The nut 30 can be turned ten revolutions clockwise or counter clockwise to accomplish this. The latter is the final adjustment.

In an actual handle that was constructed, the following dimensions were used.

Nylon guide blocks (32 and 32') were ¼ inch thick and holes 34 and 34' were 1/16 inch in diameter. Hole 36 was 5/32 inch in diameter.

Brass clamp 48 was 1/16 inch thick and its central hole 46 was 7/64 inch in diameter.

Aluminum crossbar 18 had ¼ inch holes 22 and 22' for passage of ¼ inch, 20 threads per inch aluminum bolts 26 and 26', respectively, as well as supporting nuts 24 and 24'. Slots 40 and 40' were ⅛ inch wide for passage of 1/16 inch cable 6. Central opening 44 in crossbar 18 was 7/64 inch in diameter for passage of a 4–40 screw.

Adjustment knobs 30 and 30' have ¼ inch openings and have 20 threads per inch and are commonly available at camera shops in that they are the knobs that hold a camera to its case. Such knobs are exceedingly helpful in that two complete revolutions will change the cable 6 length by a 1/10 inch, such change producing a trim change that the operator can readily sense when he puts his plane through maneuvers.

All holes made in the handle elements are chamfered on both sides of each element containing a hole, particularly those holes through which the cable 6 will pass to prevent chafing of the cable 6.

What is particularly effective about the handle described herein is that the line width of a cable is infinitely adjustable over the usable range of the airplane being flown and the movable nylon blocks 32 and 32' provide accurate and long-life adjustment, so that a given handle, once "broken-in", will serve as a reliable unit that will be compatible with all types of U-line control planes using such handle. The handle, by allowing for use of different length bolts 26 and 26', can change the overhang of a handle. Thus a single handle can achieve both overhang and infinite line width changes in a simple but effective manner. The completed handle, using solid pine wood for the grippable part of the handle, weighs four ounces. It could be made lighter by using balsa and plywood instead of pine. Strength must not be sacrificed, however, in that the handle must be able to withstand a considerable pull test.

The closest prior art known to the inventor is an article written by him and published on page 23 of the August 1970 issue of "Model Airplane News" published by Air Age Inc., 1 North Broadway, White Plains, N.Y. 10601.

What is claimed is:

1. A U-control handle for controlling the flight of a powered airplane by a cable secured to said handle and said airplane comprising:

a member adapted to be gripped by a hand of the person controlling said flight;

two parallel channels in said member, each located respectively at opposite ends of said member;

a movable bolt in each channel having nuts thereon so that each bolt can be individually set in a chosen position and locked in that position by the free hand of the person holding said handle;

a cross-bar secured to an end of each bolt so that said bar is substantially parallel to said member being gripped;

multiple openings in said cross-bar;

two nylon blocks adjustably lockable along the length of said cross-bar through said openings, and passageways in said blocks for allowing the passage of said cable therethrough.

2. The handle of claim 1 including an adjustable and lockable plate secured to said cross-bar for securing said cable thereto after said nylon blocks have been fixedly positioned on said cross-bar.

3. The handle of claim 2 wherein said adjustable and lockable plate is located on said cross-bar between said nylon blocks.

4. The handle of claim 1 wherein the multiple openings in said cross-bar are substantially colinear.

5. A U-control handle for controlling the flight of a powered airplane by a cable secured to said handle and said airplane comprising:

a member adapted to be gripped by a hand of the person controlling said flight;

two parallel channels in said member, each located respectively at opposite ends of said member;

a movable element in each channel capable of being individually set in a chosen position and locked in that position by the free hand of the person holding said handle;

a cross-bar secured to an end of each of said movable elements;

multiple openings in said cross-bar;

two nylon blocks adjustably lockable along the length of said cross-bar through said openings; and passageways in said blocks for allowing the passage of said cable therethrough.

* * * * *